US008603944B2

(12) United States Patent
Morimitsu et al.

(10) Patent No.: US 8,603,944 B2
(45) Date of Patent: Dec. 10, 2013

(54) OLIGOMERIC SPIROPYRANS FOR ERASABLE MEDIUM APPLICATIONS

(75) Inventors: Kentaro Morimitsu, Mississauga (CA); Tyler Norsten, Felicium Court (SG); Gabriel Iftime, Mississauga (CA); Peter M. Kazmaier, Mississauga (CA)

(73) Assignee: Xerox Corporation, Norwalk, CT (US)

( * ) Notice: Subject to any disclaimer, the term of this patent is extended or adjusted under 35 U.S.C. 154(b) by 1013 days.

(21) Appl. No.: 12/603,227

(22) Filed: Oct. 21, 2009

(65) Prior Publication Data

US 2011/0092364 A1 Apr. 21, 2011

(51) Int. Cl.
*B41M 5/20* (2006.01)

(52) U.S. Cl.
USPC ..... 503/218; 428/195.1; 428/211.1

(58) Field of Classification Search
USPC ..... 428/195.1, 211.1; 503/201, 218
See application file for complete search history.

(56) References Cited

U.S. PATENT DOCUMENTS

| | | | | |
|---|---|---|---|---|
| 3,212,898 | A * | 10/1965 | Cerreta | 430/345 |
| 2005/0244743 | A1* | 11/2005 | Iftime et al. | 430/270.1 |
| 2007/0054215 | A1* | 3/2007 | Iftime et al. | 430/270.1 |
| 2007/0072110 | A1* | 3/2007 | Iftime et al. | 430/270.1 |
| 2011/0059545 | A1* | 3/2011 | Salman et al. | 436/164 |

FOREIGN PATENT DOCUMENTS

WO WO 2008090045 A1 * 7/2008

OTHER PUBLICATIONS

Cho et al., Multifunctional photochromic spiropyran dendrimers and their relaxation behaviors of photochromism, Thin Solid Films, 2006, 500, p. 52-60.*

* cited by examiner

*Primary Examiner* — Gerard Higgins
(74) *Attorney, Agent, or Firm* — MH2 Technology Law Group LLP

(57) ABSTRACT

Exemplary embodiments provide compositions and methods for making and using an erasable medium that can contain oligomeric photochromic materials such as spiropyran oligomers, wherein the oligomeric photochromic material can include a plurality of photochromic groups such as spiropyrans covalently connected together by one or more linkers.

10 Claims, 13 Drawing Sheets

OLIGOMERIC SPIROPYRANS FOR ERASABLE MEDIUM APPLICATIONS

FIELD OF USE

The present teachings relate generally to erasable media and, more particularly, to compositions and methods for making and using erasable media that contain oligomeric photochromic materials.

BACKGROUND

Current transient document technology enables images written on an erasable medium based on photochromic color change of photochromic materials, such as spiropyrans.

Spiropyrans (SPs) undergo reversible color change when irradiated at an appropriate wavelength. Typically, an ultraviolet (UV) light exposure converts SPs from a colorless state to a colored state of merocyanine. The colored state of merocyanine reverts back to the colorless state of spiropyran upon application of a thermal treatment as described by the following:

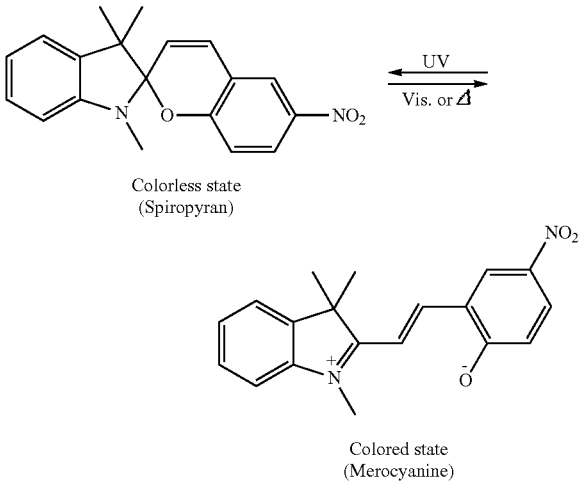

This color change is caused by a chemical structural change that involves absorption spectral change in the visible region. The color conversion and the color reversion are used to write and/or erase images.

Images are written visibly by a color contrast between an image and the surrounding background regions and are erased by removal of such color contrast. Visible images on conventional erasable media are readable for a few hours such as about 2-4 hours under ambient light conditions, and are often self-erased with no effort from the user and ready to be written or used again with new images in 24 hours.

On the other hand, longer image lifetimes and erase-on-demand capabilities are also desirable for erasable media. For example, it would be desirable for information on an erasable medium to be readable for as long as required by users, then erased or re-imaged on demand.

Thus, there is a need to overcome these and other problems of the prior art and to provide compositions and methods of erasable media having longer image lifetime and longer image readability.

SUMMARY

According to various embodiments, the present teachings include an erasable medium. The erasable medium can include a substrate and an imageable photochromic layer disposed on the substrate. The imageable photochromic layer can further include a plurality of spiropyran groups covalently connected together by a linker and dispersed in a polymer.

According to various embodiments, the present teachings also include a method for making an erasable medium. In the method, at least one spiropyran oligomer can be provided including a plurality of spiropyran groups covalently connected together by a linker. A composition that includes the at least one spiropyran oligomer and a polymer in a solvent can then be formed, and applied to a substrate, and then solidified to form an imageable photochromic layer on the substrate.

According to various embodiments, the present teachings further include a method for forming a transient image. To form the transient image, an erasable medium can first be provided. The erasable medium can include a substrate and a photochromic layer disposed on the substrate, wherein the photochromic layer can include a plurality of spiropyran groups covalently connected together by a linker and dispersed in a polymer. The erasable medium can then be exposed to a radiant energy to form a visible image that is readable for at least about 4 hours.

It is to be understood that both the foregoing general description and the following detailed description are exemplary and explanatory only and are not restrictive of the present teachings, as claimed.

BRIEF DESCRIPTION OF THE DRAWINGS

The accompanying drawings, which are incorporated in and constitute a part of this specification, illustrate several embodiments of the present teachings and together with the description, serve to explain the principles of the present teachings.

Figure 1A:
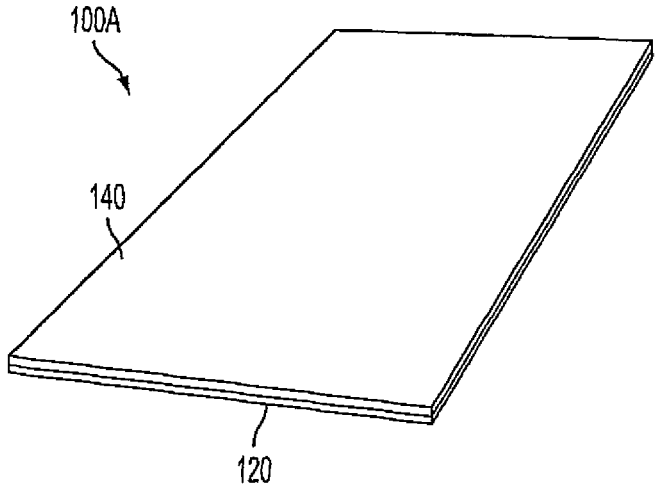
FIG. 1A depicts an exemplary erasable medium in accordance with various embodiments of the present teachings.

It should be noted that some details of the figures have been simplified and are drawn to facilitate understanding of the embodiments rather than to maintain strict structural accuracy, detail, and scale.

DESCRIPTION OF THE EMBODIMENTS

Reference will now be made in detail to embodiments of the present teachings, examples of which are illustrated in the accompanying drawings. Wherever possible, the same reference numbers will be used throughout the drawings to refer to the same or like parts.

In the following description, reference is made to the accompanying drawings that form a part thereof, and which are shown by way of illustration specific exemplary embodiments in which the present teachings may be practiced. These embodiments are described in sufficient detail to enable those skilled in the art to practice the present teachings and it is to be understood that other embodiments may be utilized and that changes may be made without departing from the scope of the present teachings. The following description is, therefore, merely exemplary.

Exemplary embodiments provide compositions and methods for an erasable medium that includes a photochromic layer over a substrate. The photochromic layer can include at least one photochromic oligomer including, for example, a plurality of photochromic groups such as spiropyran groups linked together by a linker. The photochromic layer can be an imageable and/or re-imageable photochromic layer. In embodiments, the use of photochromic oligomers for the imageable/re-imageable photochromic layer can provide for longer readability and longer lifetime of written images.

As used herein, the term "oligomer" refers to a chemical material that includes a plurality of molecules or groups. The molecules or groups of the oligomer can be covalently connected by one or more linkers. In embodiments, "oligomers" can have a particular chemical and/or geometric structure but can not grow any more toward producing a polymer, which is different than conventional oligomers. Conventional oligomers often refer to low molecular weight intermediates generated during a polymerization reaction and ready to react further to produce a polymer.

In various embodiments, exemplary linked spiropyran groups can be tethered close enough to interact with each other in the polar, ring-opened colored state. This results in improved photo- and/or thermal-stability of the colored state of linked merocyanines in response to radiant energy and/or heat. The colored state of the linked merocyanines can have a longer "lifetime" before fully reverting or transitioning back to the colorless state of the linked spiropyran groups, as compared with a photochromic layer that only contains unlinked spiropyran groups.

As disclosed herein, the term "lifetime" refers to the time for the linked merocyanines (i.e., in the colored state) to fully revert or transition back to the colorless state of the linked spiropyran groups in an ambient condition. In various embodiments, the lifetime of images and/or text on the disclosed erasable media that contain oligomeric photochromic materials can be about 4 hours or more. In some embodiments, such increased lifetime in an ambient condition can range from about 1 day (i.e., 24 hours) to about 1 week, or about 2 weeks or more.

As used herein, the term "ambient condition" refers to an indoor ambient environment including a light condition that has a light wavelength ranging from about 380 nm to about 750 nm at room temperature ranging from about 20° C. (68° F.) to about 25° C. (77° F.).

In embodiments, images formed by radiant energy in or on the disclosed imageable/re-imageable photochromic layer can be visible due to a color contrast between the formed image and the surrounding background areas.

As used herein, the term "color contrast" refers to a contrast between for example two, three or more different colors. The term "color" may encompass a number of aspects such as hue, lightness and saturation, where one color may be different from another color if the two colors differ in at least one aspect. For example, two colors having the same hue and saturation but are different in lightness would be considered different colors. Any suitable colors such as, for example, red, white, black, gray, yellow and purple, can be used to produce a color contrast as long as the temporary image is visible to the naked eye of a user. In various exemplary embodiments, the following exemplary color contrasts can be used: purple temporary image on a white background; yellow temporary image on a white background; dark purple temporary image on a light purple background; or light purple temporary image on a dark purple background.

In embodiments, the color contrast of the image written on the erasable medium can be maintained so as to be readable or recognized by an observer under an ambient condition, even though the color contrast may change, for example, it can diminish during the visible time.

As used herein, the term "readability" of an image encompasses any degree of color contrast, between the image written in/on the disclosed photochromic layer of erasable media and the surrounding background areas, sufficient to render the image discernable to an observer or user, regardless of whether the color contrast changes or is constant during the visible time.

In embodiments, the "readability" or "visibility" for an image written in/on the disclosed photochromic layer can be determined by a ΔOD value. ΔOD refers to an optical density (OD) difference between the image ($OD_{image}$) and the surrounding background areas ($OD_{background}$) and can be used to characterize color contrast there-between.

For example, the image written in/on the disclosed photochromic layer can be "readable" and have a ΔOD value of about 0.05 or more. In embodiments, the written image can be "readable" having a ΔOD value about 0.1 or more, including about 0.2 or more. In embodiments, the image written in/on the disclosed photochromic layer can be readable for an extended time due to the improved photo- and/or thermal-stability of the colored state of linked merocyanines.

In various embodiments, the image written in/on the disclosed photochromic layer can be "readable" for at least about four or at least about eight hours, and in some cases, even for at least about twelve or at least about twenty-four hours. In other embodiments, the color contrast of the written image on the erasable medium can be maintained or readable for a period of time of at least about two days or at least about four days, and, in some cases, at least about one week or at least about three weeks.

As used herein, the term "erasable medium" refers to a substrate including an imaging medium that can be reused multiple times to transiently store and/or remove images and/or text. In embodiments, the imaging medium can include a photochromic material that can undergo reversible color change to enable image-writing and image-erasing.

The substrate of the erasable medium can be, for example paper, glass, ceramic, wood, plastic, fabric, textile, and/or metal. In embodiments, the "erasable medium" can have the appearance and feel of traditional paper, including cardstock and other weights of paper. As used herein, the term "imaged erasable medium" refers to an erasable medium bearing a visible image, the image a result of, for example, ultraviolet (UV) writing of the erasable medium.

As used herein, the term "non-imaged erasable medium" refers to an erasable medium which has not been previously imaged, or an erasable medium having an image erased therefrom and available for writing. Exemplary erasable media are described in connection with FIGS. 1A-1B below.

FIG. 1A depicts an exemplary erasable medium 100A in accordance with various embodiments of the present teachings. It should be readily apparent to one of ordinary skill in the art that the medium 100A depicted in FIG. 1A represents a generalized schematic illustration and that other components can be added or existing components can be removed or modified.

As shown, the medium 100A can include a substrate 120 and a photochromic layer 140 disposed over the substrate 120.

In various embodiments, the substrate 120 can be made of a flexible or a rigid material and can be transparent or opaque. The substrate 120 can include, for example, any suitable material such as paper, wood, glass, ceramic, plastics, fabrics, textile products, polymeric films, inorganic substrates such as metals, and the like. The paper can include, for example, plain papers such as XEROX® 4024 papers, ruled notebook paper, bond paper, silica coated papers such as Sharp Company silica coated paper, Jujo paper, and the like. The plastic can include, for example, a plastic film, such as polyethylene film, polyethylene terepthalate, polyethylene naphthalate, polystyrene, polycarbonate, polyethersulfone. The substrate 120, such as a sheet of paper, can have a blank appearance.

In various embodiments, the substrate 120 can be a single layer or multi-layer where each layer is the same or different material and can have a thickness, for example, ranging from about 0.1 mm to about 10 mm and in some cases ranging from about 0.3 mm to about 5 mm.

The photochromic layer 140 can be impregnated, embedded or coated to the substrate 120, for example, a porous substrate such as paper. In various embodiments, the photochromic layer 140 can be applied uniformly to the substrate 120 and/or fused, or otherwise permanently affixed thereto.

Figure 1B:
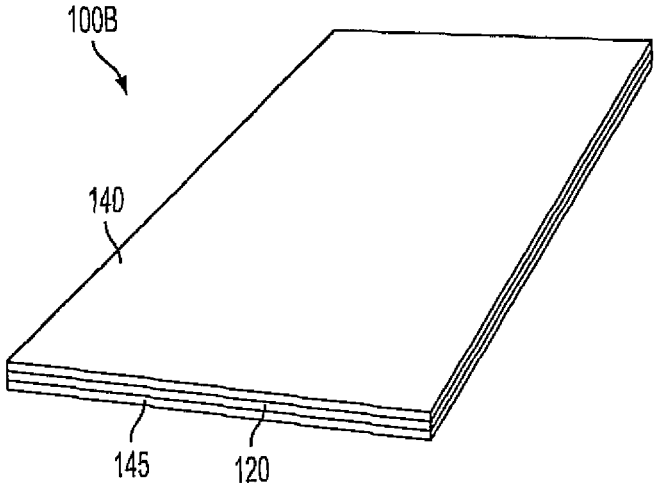
FIG. 1B depicts another exemplary erasable medium in accordance with various embodiments of the present teachings.

FIG. 1B shows another exemplary erasable medium 100B in accordance with various embodiments of the present teachings. As compared with the erasable medium 100A, the erasable medium 100B can further include a second photochromic layer 145 disposed over the substrate 120 on a side opposite to the photochromic layer 140. In various embodiments, the second photochromic layer 145 and the photochromic layer 140 can be the same or different.

The photochromic layer 140 or 145 can include, for example, at least one photochromic oligomer that includes a number of photochromic groups linked together, for example, by one or more linkers. FIGS. 2A-2D schematically depict various exemplary photochromic oligomers 200A-D used for the photochromic layer 140 or 145 of FIGS. 1A-1B in accordance with various embodiments of the present teachings.

As shown, each of the exemplary photochromic oligomers 200 can include a number of photochromic groups 210 linked together by linkers 205. Although certain numbers of photochromic groups 210 are shown in FIGS. 2A-2D for each exemplary photochromic oligomer 200, one of ordinary skill in the art will understand that other numbers of photochromic groups 210 can be linked together by one or more linkers 205 to form one photochromic oligomer. In embodiments, the one or more linkers 205 can be the same or different.

In various embodiments, photochromic groups 210 can be linked together without using linkers 205 (not shown). For example, a dual functional photochromic group can react or aggregate with one another to form oligomers.

In some embodiments, the photochromic oligomer used for the photochromic layer 140, 145 can include, for example, at least 2 photochromic groups 210. In other embodiments, the photochromic oligomer 200 can include photochromic groups 210 such as spiropyran groups of about 2 to about 10 that are linked together. In yet other embodiments, about 2 to about 4 photochromic groups 210 or spiropyran groups can be linked together to form one photochromic oligomer 200.

In various embodiments, the photochromic groups 210 can include, but are not limited to, spiropyrans and related compounds like spirooxazines and thiospiropyrans, benzos and naphthopyrans (chromenes), stilbenes, azobenzenes, bisimidazols, spirodihydroindolizines, quinines, perimidinespirocyclohexadienones, viologens, fulgides, fulgimides, diarylethenes, hydrazines, anils, aryl thiosulfonates, spiroperimidines and the like, and combinations thereof.

Figure 2A:
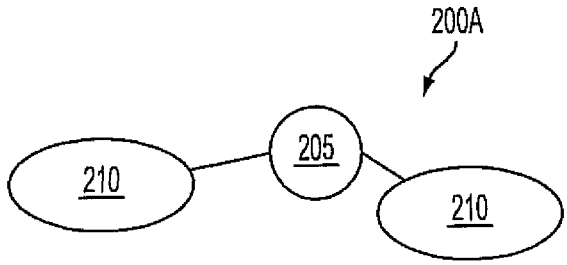
FIGS. 2A-2D depict various exemplary photochromic oligomers used for the exemplary erasable medium of FIG. 1 in accordance with various embodiments of the present teachings.
Figure 2B:
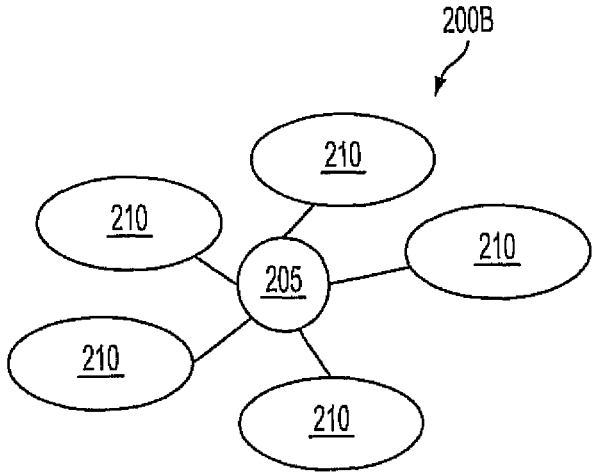
Figure 2C:
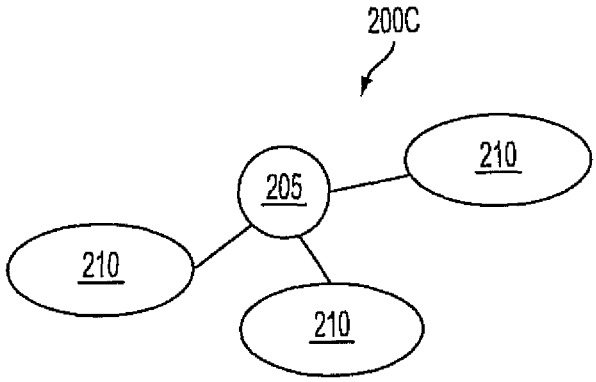
Figure 2D:
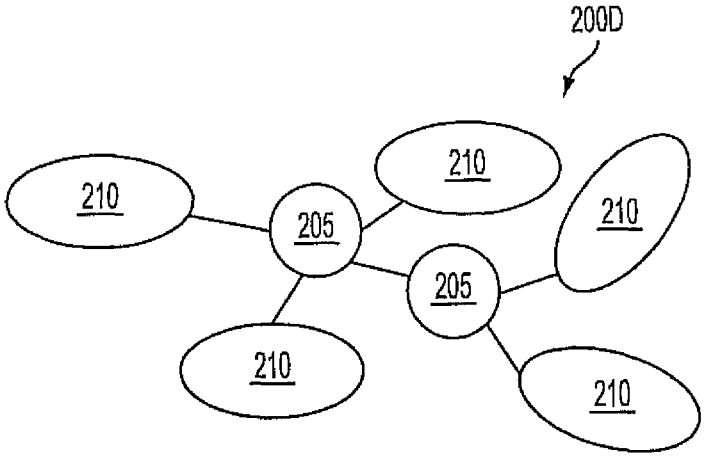

In various embodiments, each photochromic group 210 can have functional group(s), or can be a modified photochromic group having functional groups, for physically or chemically reacting with the linker 205. In embodiments, the linkers 205 can react with one another, as shown in FIG. 2D with one or more photochromic groups 210 attaching to each linker 205.

In various embodiments, the functional groups of the photochromic group 210, reacting with linker 205 or another group 210, can include, but are not limited to, a carboxylic acid group, an amino group, a hydroxyl group, a halogenated hydrocarbon, a unsaturated hydrocarbon, an aldehyde, an acid chloride, an acid bromide, a thiol, a thioester, an azide, a boronic acid, or a boronic ester.

In various embodiments, in addition to the functional groups described above, the photochromic groups 210 can further include other substituents, such as, for example, a methoxy substituent, a halogen atom, saturated or unsaturated hydrocarbons, a nitro group, a cyano group, a ketone, a carboxylic acid group, an amino group, a hydroxyl group, a halogenated hydrocarbon, a unsaturated hydrocarbon, an aldehyde, an acid chloride, an acid bromide, a thiol, a thioester, an azide, a boronic acid, a boronic ester and combinations thereof.

In various embodiments, the linker 205, reacting with the photochromic group 210 or another linker 205, can be, for example, a bond, or an atom, such as S, O, N, a linear or branched, or cyclic alkyl, unsaturated hydrocarbon, an aryl or arylalkyl group, a heteroaryl group, an ester group, a ketone, an ether group, an amide group, a thioester group, a thionoester group and combinations thereof.

In an exemplary embodiment, spiropyran (SP) oligomers containing at least 2 spiropyran groups, such as from about 2 to about 10 groups or from about 2 to about 4 groups, can be used as the photochromic oligomers 210 for the photochromic layer 140, 145 of FIGS. 1A-1B.

In embodiments, the spiropyran groups can include spiropyran and related compounds. In embodiments, the spiropyran groups can include spiropyrans having various substituents, such as methoxy. In embodiments, the spiropyran groups can include, such as, for example, spiropyrans, spirooxazines, thiospiropyrans, methoxy spiropyran and the like and their combinations.

Figure 3:
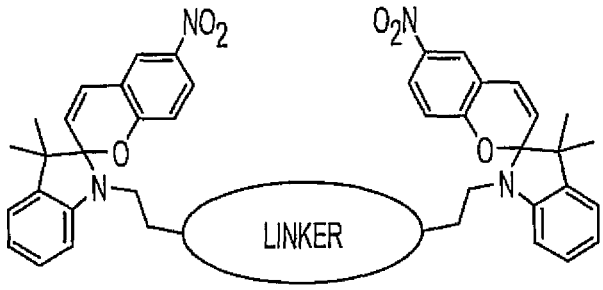
FIG. 3 depicts an exemplary spiropyran dimer having two spiropyran groups linked together by a covalent linker in accordance with various embodiments of the present teachings.

In embodiments, each oligomeric form of spiropyrans can have a number of spiropyran groups physically or chemically combined by one or more linkers. FIG. 3 shows an exemplary spiropyran oligomer, i.e., spiropyran dimer, having two spiropyran groups linked together by a covalent linker.

Figure 4:
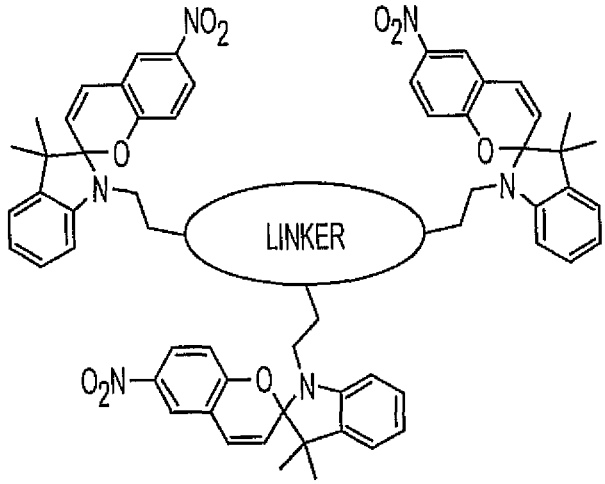
FIG. 4 depicts an exemplary spiropyran trimer having three spiropyran groups linked together by a covalent linker in accordance with various embodiments of the present teachings.

FIG. 4 shows another exemplary spiropyran oligomer, i.e., spiropyran trimer having three spiropyran groups linked together by, for example, a covalent linker.

In various embodiments, the covalent linker for forming spiropyran oligomers can include, but is not limited to,

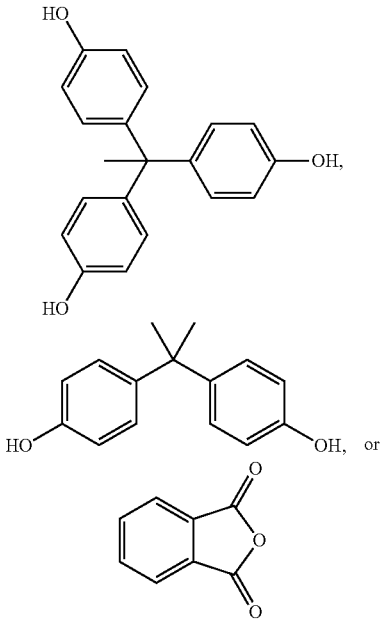

In embodiments, the spiropyran oligomers can further include, e.g., H-aggregation structure, J-aggregation structure, dendrimer type structure or combinations thereof.

In embodiments, the linkers used for forming spiropyran oligomers can be selected small enough for SP groups to interact. In embodiments, the linkers used for forming spiropyran oligomers can be selected to provide suitable type of covalent bonds considering synthetic easiness, cost of material, commercial availability, etc.

In certain embodiments, a protection film can be used to locally or wholly cover an imaged photochromic layer 140, 145 of the erasable media 100A-B. The protection film can be an appropriate filter film to cut unnecessary ultraviolet light from, for example, a fluorescent lamp.

In specific embodiments, the protection film can be, for example, a light absorbing film, for example, a yellow film disposed on the imaged photochromic layer 140, 145 to prevent the reduction in color contrast between the images and the surrounding background areas.

In various embodiments, the light absorbing film can be made of a number of materials, including transparent plastic films and the like. If permanently attached to the erasable medium 100A-B, the light absorbing material can adsorb maximally in the region of 380 nm-500 nm and adsorb minimally in the region of 250 nm-380 nm to allow for UV-based imaging of the erasable media. Such combinations of materials can exhibit acceptable levels of reduction in color contrast when exposed to ambient UV fluorescent light. The light absorbing film can have a thickness of from about 0.005 mm to about 1 mm, or from about 0.05 mm to about 1 mm, or from about 0.5 mm to about 1 mm. In this manner, these embodiments can provide a manner of achieving coloration in desired areas and eliminating unwanted reduction in color contrast from the UV light present in indoor ambient conditions.

In another embodiment, the light absorbing film can function as a detachable cover for the erasable medium 100A-B in which the exemplary yellow film cover can be slipped over or reversibly attached to the erasable medium after the erasable medium is subjected to the radiant energy, for example, an UV light. In this embodiment, the light absorbing film does not need to be substantially optically transparent in the UV region. Alternatively a light absorbing dye can be incorporated into the polymer and or into the photochromic layer 140, 145 itself. Any suitable light absorbing dye can be used so long as the dye is soluble or dispersable in the coating composition selected.

Referring back to FIGS. 1A-1B, in embodiments, the photochromic layer 140, 145 can optionally include binder materials. The binder materials can be, for example, a suspending medium to hold the photochromic materials, in this case, the photochromic oligomers, as a film or layer on the substrate of interest. The binder materials can provide any or all of the following properties, such as, for example, mechanical flexibility, robustness, and optical clarity. Any suitable binder materials can be used, for example, a polymer material.

Examples of polymer materials that can be used as binder materials can include: polyalkylmethacrylates like polymethylmethacrylates (PMMA), polycarbonates, polystyrenes, polysulfones, polyethersulfones, polyarylsulfones, polyarylethers, polyolefins, polyacrylates, polyvinyl derivatives, cellulose derivatives, polyurethanes, polyamides, polyimides, polyesters, silicone resins, epoxy resins, polyvinyl alcohols, polyacrylic acids and the like. Copolymer materials such as polystyrene-acrylonitriles, polyethylene-acrylates, vinylidenechloride-vinylchlorides, vinylacetate-vinylidene chlorides, styrene-alkyd resins can also be examples of suitable binder materials. The copolymers may be block, random, or alternating copolymers.

In various exemplary embodiments, photochromic oligomers such as spiropyran oligomers can be dispersed in the binder material or the polymer in an amount ranging from about 0.05 to about 99.5%, or ranging from about 0.1 to about 70%, or ranging from about 1 to about 20% by weight of the total photochromic layer 140 or 145.

In various embodiments, a solvent may be used to disperse the photochromic oligomers, and the binder materials or the polymer to form a composition. The composition can enable a process to create, for example, a uniform film coating for writing and/or erasing on the substrate 120. In various embodiments, the solvent can be volatile enough so that it can be conveniently removed during subsequent drying. Water can be used as a solvent for water soluble polymers such as poly(vinyl alcohol). Other suitable solvents can include, for example, halogenated and nonhalogenated solvents, such as tetrahydrofuran, trichloro- and tetrachloroethane, dichloromethane, chloroform, monochlorobenzene, toluene, acetone, methanol, ethanol, xylene, benzene, ethyl acetate and the like.

In various exemplary embodiments, the compositions can be prepared by, for example, dispersing photochromic oligomers into a polymer solution in presence of a suitable solvent. In a specific embodiment, spiropyran (SP) oligomers, such as, for example, SP trimer, SP phthalic-dimer, MeO-SP dimer and/or MeO-SP trimer can be prepared and dispersed in a solution that contains an exemplary polymer of PMMA in an exemplary solvent of toluene to form the composition.

In another embodiment, the solvent system with the photochromic polymer can be encapsulated or microencapsulated, and the resultant capsules or microcapsules deposited or coated on the substrate as described above. Any suitable encapsulation technique can be used including, for example, simple and complex coacervation, interfacial polymerization, in situ polymerization, and/or phase separation processes. For example, a suitable method described for ink materials in U.S. Pat. No. 6,067,185, the entire disclosure of which is incorporated herein by reference, can be readily adapted to the present disclosure.

Useful exemplary materials for simple coacervation can include, for example, gelatin, polyvinyl alcohol, polyvinyl acetate and/or cellulose derivatives. Exemplary materials for complex coacervation can include, for example, gelatin, acacia, acrageenan, carboxymethylecellulose, agar, alginate, casein, albumin, and/or methyl vinyl ether-co-maleic anhydride. Exemplary useful materials for interfacial polymerization can include diacyl chlorides such as sebacoyl, adipoyl, and di or poly-amines or alcohols and isocyanates. Exemplary useful materials for in situ polymerization can include for example polyhydroxyamides, with aldehydes, melamine or urea and formaldehyde; water-soluble oligomers of the condensate of melamine or urea and formaldehyde, and vinyl monomers such as for example styrene, methyl methacrylate and acrylonitrile. Exemplary useful materials for phase separation processes can include polystyrene, polymethylmethacrylate, polyethylmethacrylate, ethyl cellulose, polyvinyl pyridine and/or polyacrylonitrile. In these embodiments, the encapsulating material can also be transparent and colorless in order to provide the full color contrast effect provided by the photochromic material.

Where the photochromic polymer is encapsulated, the resultant capsules can have any desired average particle size. For example, suitable results can be obtained with capsules having an average size of from about 2 to about 1000 microns, such as from about 10 to about 600 or to about 800 microns, or from about 20 to about 100 microns. The average size refers to the average diameter of the microcapsules and can be readily measured by any suitable device such as an optical microscope. In exemplary embodiments, the capsules can be large enough to hold a suitable amount of photochromic material to provide a visible effect when in the colored form, but can not be as large as to prevent desired image resolution.

Various coating techniques as known to one of ordinary skill in the art can be used to apply the composition on at least one side of the substrate 120. A photochromic layer or film can then be formed by drying the applied coating composition containing, such as spiropyran oligomers.

In embodiments, a second imageable photochromic layer can be formed over the substrate on a side opposite to the coated photochromic layer by, for example, first forming a composition including at least one spiropyran oligomer and a polymer in a solvent; and then applying the composition to the substrate on the opposite side and solidifying the composition to form the second imageable photochromic layer.

According to various embodiments, the photochromic oligomers can change from a colorless state to a colored state when exposed to radiant energy, for example, illuminated with UV light at a first wavelength. Image readability and lifetime can be extended due to use of the oligomeric structures in the erasable medium, while writability and erasability of the erasable medium are not deteriorated. The erasable medium may then be erased by heat generated from, for example, an IR radiation and/or optionally a visible light at a second wavelength.

Various embodiments can also include a method for using the disclosed erasable medium. For example, a transient image can be written in the photochromic layer of the erasable medium and/or can then be erased from the erasable medium. In embodiments, such erasable medium can be reused to undergo a number of cycles of temporary image formation and temporary image erasure.

Figure 5:
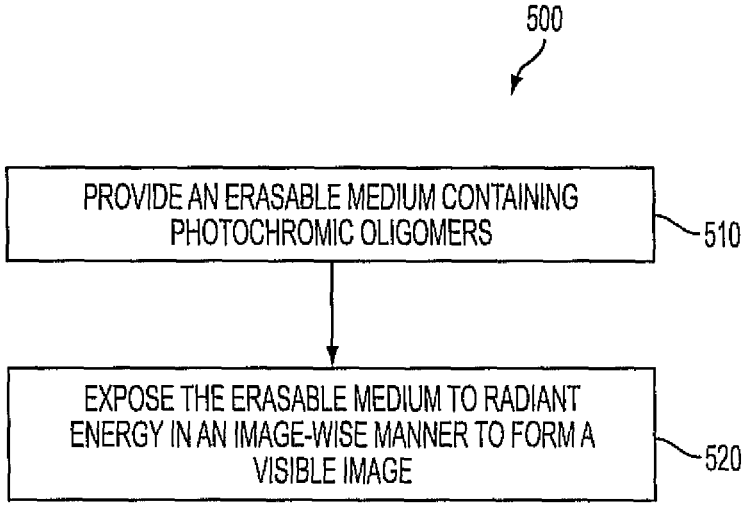
FIG. 5 depicts an exemplary method for using the erasable medium in accordance with various embodiments of the present teachings.

FIG. 5 depicts an exemplary method 500 for using the disclosed erasable medium in accordance with various embodiments of the present teachings.

At 510, an erasable medium can be provided or formed as disclosed herein. For example, the erasable medium can include a photochromic layer either coated on or impregnated into a substrate. The photochromic layer can include at least one photochromic oligomer such as spiropyran (SP) oligomer that contains a number of photochromic groups such as SP groups linked together by a linker. The at least one photochromic or SP oligomer can be dispersed in a polymer over the substrate.

At 520, the erasable medium can be exposed to radiant energy in an image-wise manner to form a visible image or a transient image.

The radiant energy can include an imaging light having any suitable predetermined wavelength range such as, for example, a single wavelength or a band of wavelengths. In various exemplary embodiments, the imaging light can be an ultraviolet (UV) light having a single wavelength or a narrow band of wavelengths selected from the UV light wavelength range of about 200 nm to about 475 nm. In an embodiment, the imaging light can be a single wavelength at about 365 nm. In another embodiment, the imaging light can be a wavelength band of about 350 nm to about 370 nm.

For each image writing, the erasable medium can be exposed to the radiant energy for a time period ranging from about 10 milliseconds to about 5 minutes, or for example, from about 30 milliseconds to about 1 minute. The imaging light can have an intensity ranging from about 0.1 $mW/cm^2$ to about 100 $mW/cm^2$, or for example, from about 0.5 $mW/cm^2$ to about 40 $mW/cm^2$.

In various exemplary embodiments, radiant energy corresponding to the predetermined image can be generated by a radiant source, for example, by a computer on a light emitting diode (LED) array screen and the temporary image can be formed or written on the erasable medium by placing the medium on the LED screen for the period of time. In other exemplary embodiments, a UV raster output scanner (ROS) or a UV laser diode (LD) can be used to generate UV light to sensitize the photochromic oligomers from a colorless state to a colored state.

In various embodiments, a protection layer can be applied to the photochromic layer of the erasable medium after the exposure to the exemplary UV light. In embodiments, the protection layer can include a yellow filter film.

In various embodiments, the erasable medium bearing the image can be erased by removing color contrast between the non-exposed region and the exposed region by the radiant energy performed at step 520 of FIG. 5.

In various exemplary embodiments, erasure of the written image can occur by any of the following: (i) changing the color of the region exposed to the radiant energy to the color of the region not exposed to the radiant energy; (ii) changing the color of the non-exposed region to the color of the exposed region; or (iii) changing the color of the exposed region and the color of the non-exposed region to the same color different from both the exposed region color and the non-exposed region color.

In one embodiment, the erasable medium bearing the image can be erased in an erase-on-demand manner. For example, the erasable medium bearing the image can be exposed to heat. The exposed region for erasure can, for example, change from the colored state to the colorless state by a heat source, such as a radiant heater that irradiates infrared (IR) light, a hotplate or the like. In embodiments, the imaged erasable medium can be heated at a temperature of at least about 40° C., or of at least about layer 70° C., or in some cases ranging from about 80° C. to about 200° C. so as to remove the color contrast between the image and its background areas.

In various embodiments, for reusing the disclosed medium, step 520 of exposing the erasable medium to radiant energy for writing can be performed at least one additional time.

The following examples are illustrative of various embodiments and their advantageous properties, and are not to be taken as limiting the disclosure or claims in any way.

EXAMPLES

Example I-1

Methoxy Substituted Spiropyran (MeO-SP)

Figure 6:
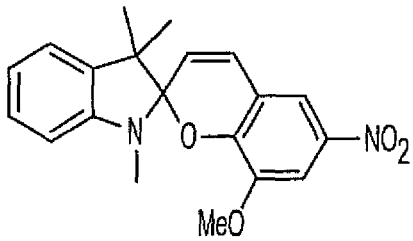
FIG. 6 depicts an exemplary methoxy substituted spiropyran (MeO-SP) in accordance with various embodiments of the present teachings.

(1',3'-Dihydro-8-methoxy-1',3',3'-trimethyl-6-nitrospiro[2H-1-benzopyran-2,2'-(2H)-indole] from Sigma-Aldrich (St. Louis, Mo.) was used as an example of methoxy substituted spiropyran (MeO-SP). The exemplary MeO-SP has a structure as shown in FIG. 6.

Figure 7:
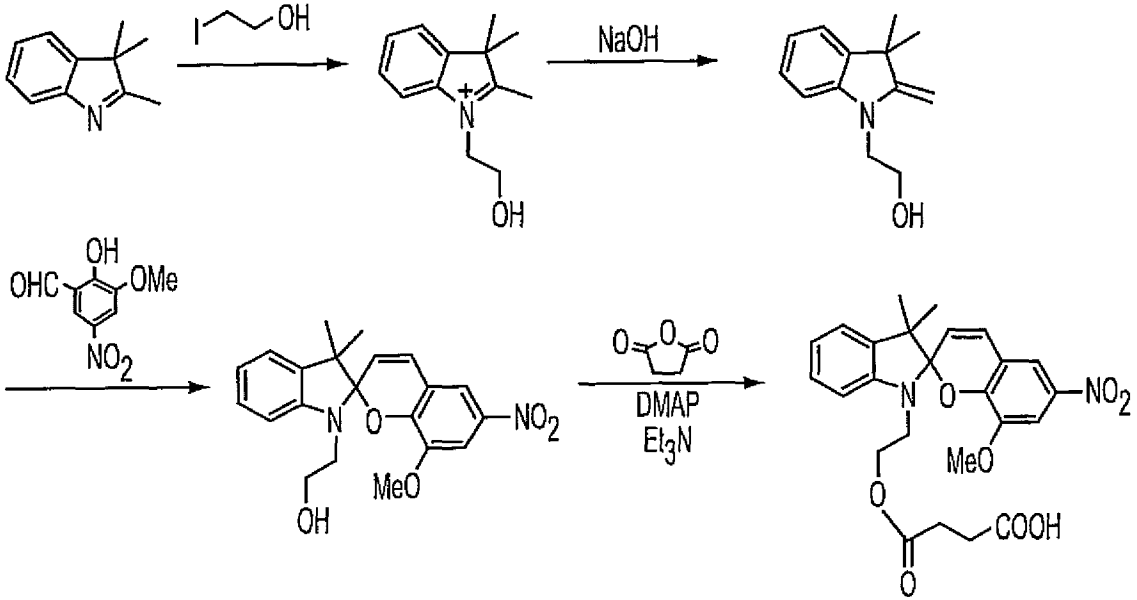
FIG. 7 depicts an exemplary preparation process of MeO-SP in accordance with various embodiments of the present teachings.

FIG. 7 shows an exemplary MeO-SP preparation process in accordance with various embodiments of the present teachings.

In a particular example for the preparation, about 16 g of 2,3,3-trimethyl-3H-indole was dissolved in about 100 ml of chloroform. After addition of about 19 g of 2-Iodoethanol, the solution was refluxed while stirring for about 1 day. After cooling, the solvent was removed and the resultant solid was filtered and washed with acetone to yield 1-(2-hydroxyethyl)-2,3,3-trimethyl-3H-indolium iodide.

About 10 g of the latter product was dissolved in about 50 ml of aqueous sodium hydroxide (1 mol/l). After stirring for about 1 hour at room temperature, the mixture was extracted with dichloromethane and dried over magnesium sulfate. After the solvent was distilled off, the residue was dissolved in about 70 ml of ethanol. After addition of about 4.93 g of 2-hydroxy-3-methoxy-5-nitrobenzaldehyde, the solution was refluxed while stirring for about 16 hours. After cooling, the solvent was distilled off. Resultant solid was filtered and washed with ethanol to yield 2-(8-methoxy-3',3'-dimethyl-6-nitrospiro[chromene-2,2'-indoline]-1'-yl)ethanol.

About 3 g of the latter product, about 0.61 ml of triethylamine, and about 0.96 g of 4-(dimethylamino)pyridine were dissolved in about 40 ml of dichloromethane. After addition of about 0.81 g of succinic anhydride, the solution was stirred under Ar at room temperature for about 1 day. The mixture was washed with 5% aqueous hydrochloric acid, aqueous sodium bicarbonate, and water, then dried over magnesium sulfate. After the solvent was distilled off, the concentrated solution was added dropwise to hexane under stirring. The resulting solid was collected by filtration to yield 4-(2-(8-methoxy-3',3'-dimethyl-6-nitrospiro[chromene-2,2'-indoline]-1'-yl)ethoxy)-4-oxobutanoic acid.

The prepared MeO-SP can have a functional group (e.g., —COOH) suitable for linking a plurality of MeO-SPs to form MeO-SP oligomers, such as a MeO-SP dimer and a MeO-SP trimer as shown in Example I-2.

Example I-2

Preparation of Oligomers: MeO-SP Dimer and MeO-SP Trimer

Figure 8:
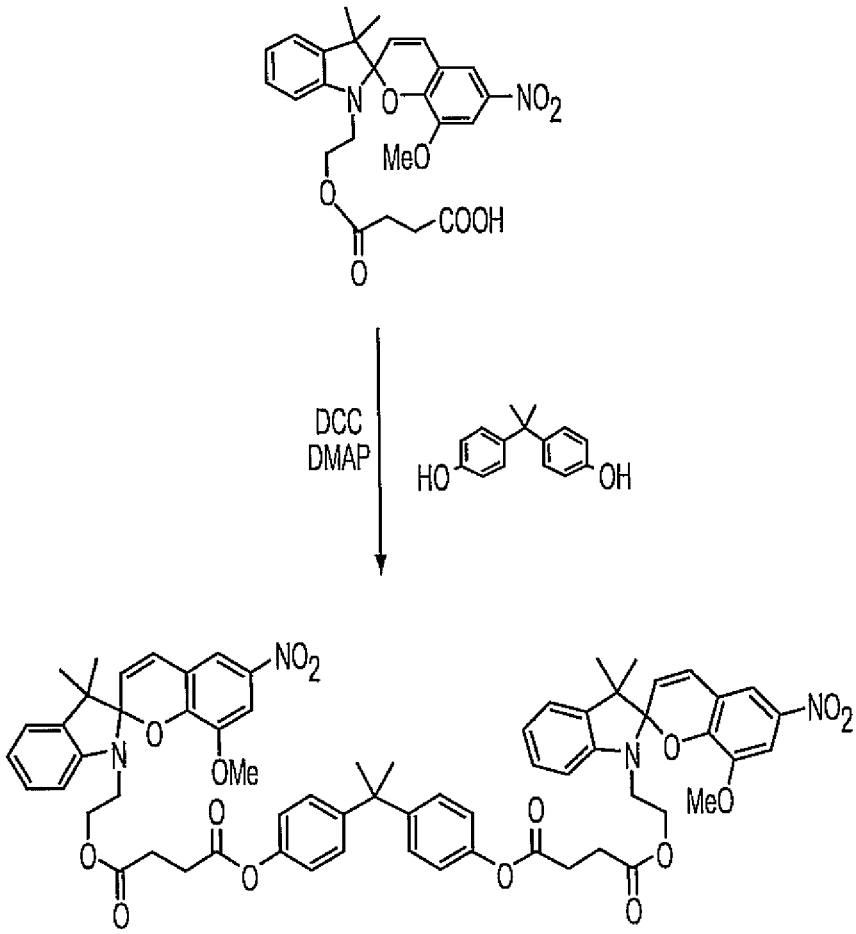
FIG. 8 depicts an exemplary preparation process of MeO-SP dimer in accordance with various embodiments of the present teachings.

FIG. 8 shows an exemplary preparation process of MeO-SP dimer, where DCC is N,N'-dicyclohexylcarbodiimide used to activate the functional group carboxylic acid for further reaction, and DMAP is 4-(dimethylamino)pyridine used catalytically.

In a particular example for the preparation of MeO-SP dimer, about 1 g of 4-(2-(8-methoxy-3',3'-dimethyl-6-nitrospiro[chromene-2,2'-indoline]-1'-yl)ethoxy)-4-oxobutanoic acid, about 0.24 g of bisphenol A, and about 0.25 g of DMAP were dissolved in about 10 ml of dichloromethane. After addition of about 0.43 g of DCC, the solution was stirred at room temperature for about 19 hours. Resulting solid was filtered off and the filtrate was washed with 5% aqueous hydrochloric acid, aqueous sodium bicarbonate, and water, then dried over magnesium sulfate. After the solvent was distilled off, the concentrated solution was added dropwise into stirred hexane. The precipitates was collected and purified with silica gel column chromatography (dichloromethane/ethyl acetate=9/1). Further precipitated in hexane yielded MeO-SP Dimer.

Figure 9:
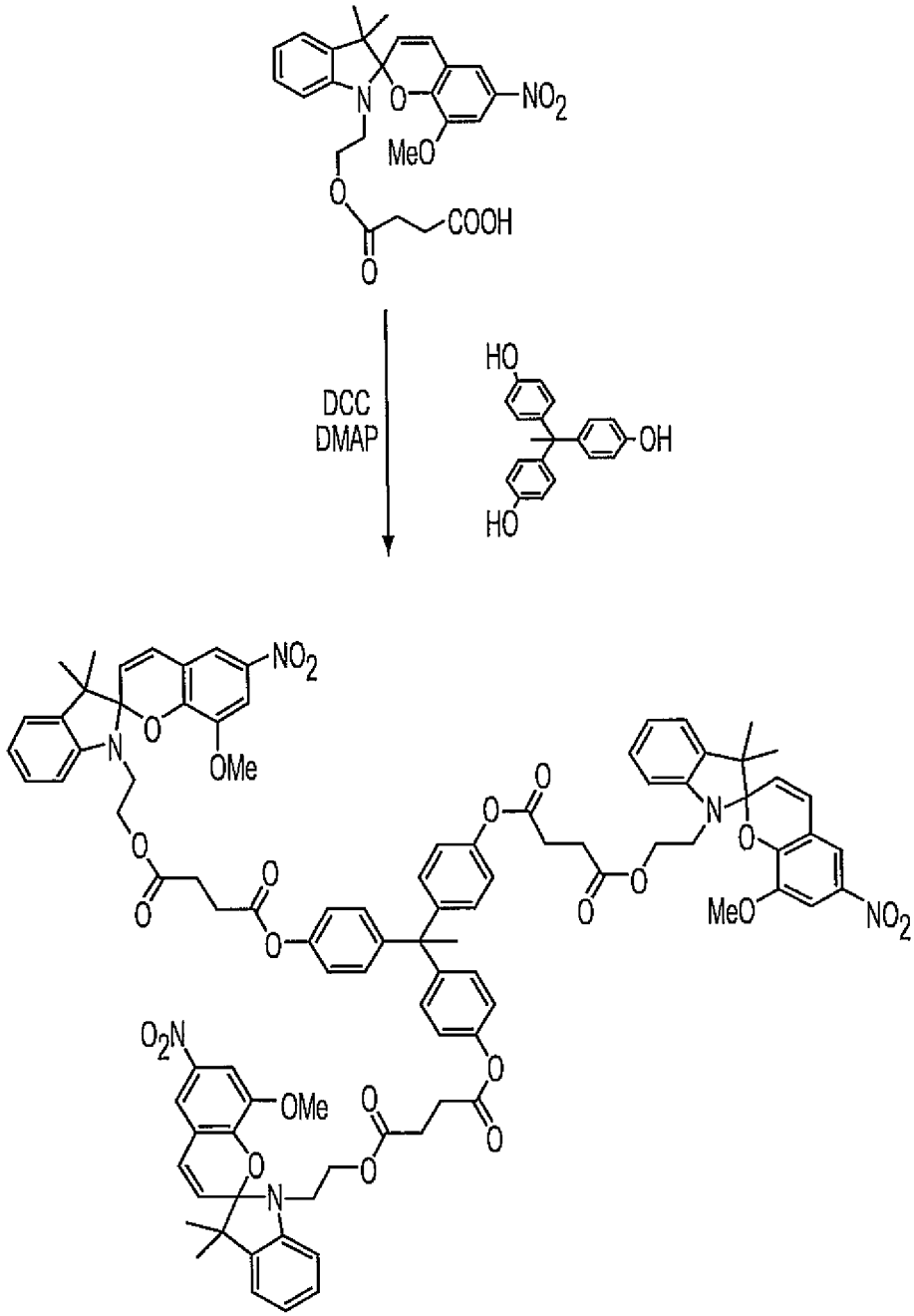
FIG. 9 depicts an exemplary preparation process of MeO-SP trimer in accordance with various embodiments of the present teachings.

FIG. 9 shows an exemplary preparation process of MeO-SP trimer, where DCC is N,N'-dicyclohexylcarbodiimide used to activate the functional group carboxylic acid for further reaction, and DMAP is 4-(dimethylamino)pyridine used catalytically.

In a particular example for the preparation of MeO-SP trimer, about 1 g of 4-(2-(8-methoxy-3',3'-dimethyl-6-nitrospiro[chromene-2,2'-indoline]-1'-yl)ethoxy)-4-oxobutanoic acid, about 0.21 g of 1,1,1-tris(4-hydroxyphenyl)ethane, and about 0.25 g of DMAP were dissolved in about 10 ml of dichloromethane. After addition of about 0.43 g of DCC, the solution was stirred at room temperature for about 19 hours. Resulting solid was filtered off and the filtrate was washed with 5% aqueous hydrochloric acid, aqueous sodium bicarbonate, and water, then dried over magnesium sulfate. After the solvent was distilled off, the concentrated solution was added dropwise into stirred hexane to yield MeO-SP Trimer.

Example I-3

Preparation of Erasable Media Containing MeO-SP, MeO-SP Dimer and MeO-SP Trimer As a control experiment that contains MeO-SP, 49 mg (0.14 mmol) of commercially available MeO-SP were dispersed in 3 ml of PMMA (35K) solution (10 w % in toluene) to form a control coating composition. The control coating composition were then be coated on Xerox 4200 paper substrate, then dried in air overnight.

Similarly, about 80 mg (0.047 mmol) of MeO-SP timer was dispersed in 3 ml of PMMA (35K) solution (10 w % in toluene) to form a coating composition. The coating composition was coated on Xerox 4200 paper substrate, then dried in air overnight. 81 mg (0.07 mmol) of MeO-SP dimer was dispersed in 3 ml of PMMA (35K) solution (10 w % in toluene) to form a coating composition. The coating composition was coated on Xerox 4200 paper substrate, then dried in air overnight.

Example I-4

Writing on Erasable Media Containing MeO-SP, MeO-SP Dimer and MeO-SP Trimer

The prepared samples of Example I-3 were partially irradiated with a UV LED at a wavelength of about 365 nm to write an image therein to make contrast between written image and background, then covered by a yellow protection filter film (Lee yellow film). The samples were placed under a 400 lux fluorescent lamp at room temperature, mimicking standard office lighting condition.

Example I-5

ΔOD Measurements of Erasable Media Containing MeO-SP, MeO-SP Dimer and MeO-SP Trimer Optical density (OD) was measured using Spectrolino Spectrophotometer from GretagMacbeth (New Windsor, N.Y.) with a software of Color Quality Lite (version 3.6) after a certain period of time from the UV light exposure so as to evaluate the lifetime of the written image in the disclosed erasable media. ΔOD, determined by the difference between $OD_{image}$ and $OD_{background}$, was used to characterize color contrast between the image and the background. Additionally, ΔOD value was normalized by dividing by initial ΔOD ($\Delta OD_{t=0}$) so that image lifetime was fairly compared in terms of decoloration ratio.

Figure 10:
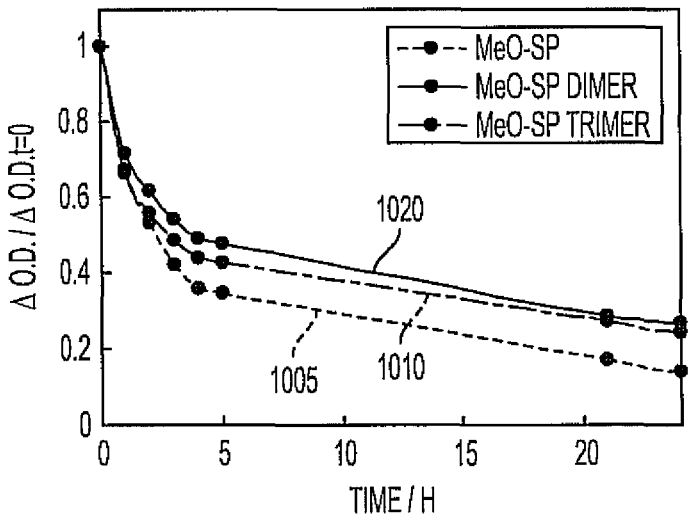
FIG. 10 depicts a comparison between exemplary erasable media containing substituted spiropyran and oligomers in accordance with various embodiments of the present teachings.

FIG. 10 shows a time trace of the normalized ΔOD for about 24 hours from writing on the erasable media of Example I-3 respectively containing MeO-SP control (see 1005), MeO-SP trimer (see 1010) and MeO-SP dimer (see 1020). As shown, visible light from fluorescent lamp caused a rapid decoloration reaction of the control sample (see 1005) in the first few hours after writing. In contrast, erasable media of Example I-3 containing MeO-SP trimer (see 1010) and MeO-SP dimer (see 1020) demonstrated a higher $\Delta OD/\Delta OD_{t=0}$ by about 10% after the first few hours.

Example I-6

Erasing of Erasable Media Containing MeO-SP, MeO-SP Dimer and MeO-SP Trimer

Written samples in Example I-4 containing MeO-SP control, MeO-SP trimer and MeO-SP dimer were placed on a hot plate at about 100° C. After about 10 seconds, complete erase of the written image on each sample was observed.

Example II-1

Spiropyran (SP)

Figure 11:
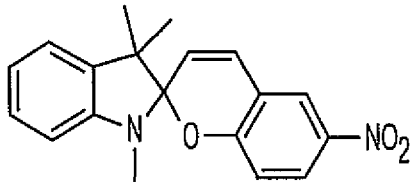
FIG. 11 depicts an exemplary spiropyran (SP) in accordance with various embodiments of the present teachings.

1,3,3-Trimethylindolino-6'-nitrobenzopyrylospiran from TCI America (Portland, Oreg.) was used as an example of spiropyran having a structure as shown in FIG. 11.

Example II-2

Preparation of SP Oligomers: SP Phthalic-Dimer and SP Trimer

Figure 12:
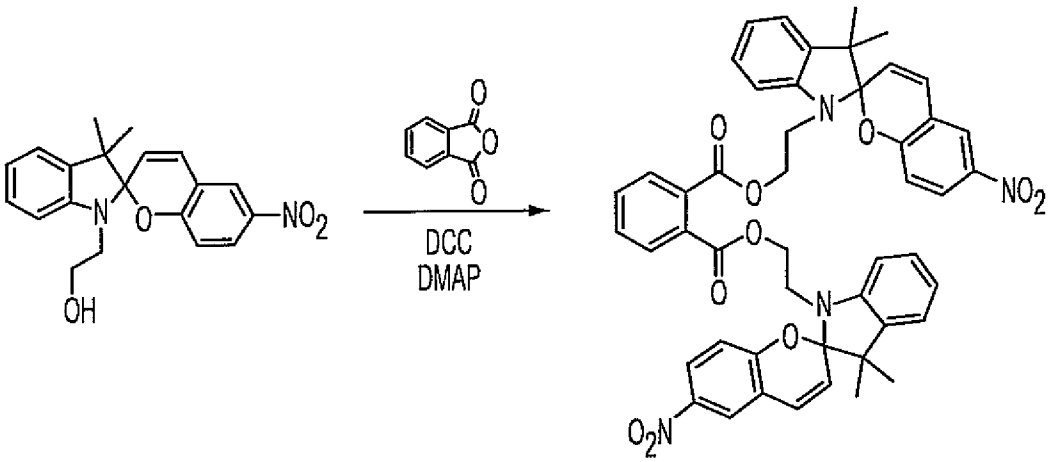
FIG. 12 depicts an exemplary preparation process of SP phthalic-dimer in accordance with various embodiments of the present teachings.
Figure 13:
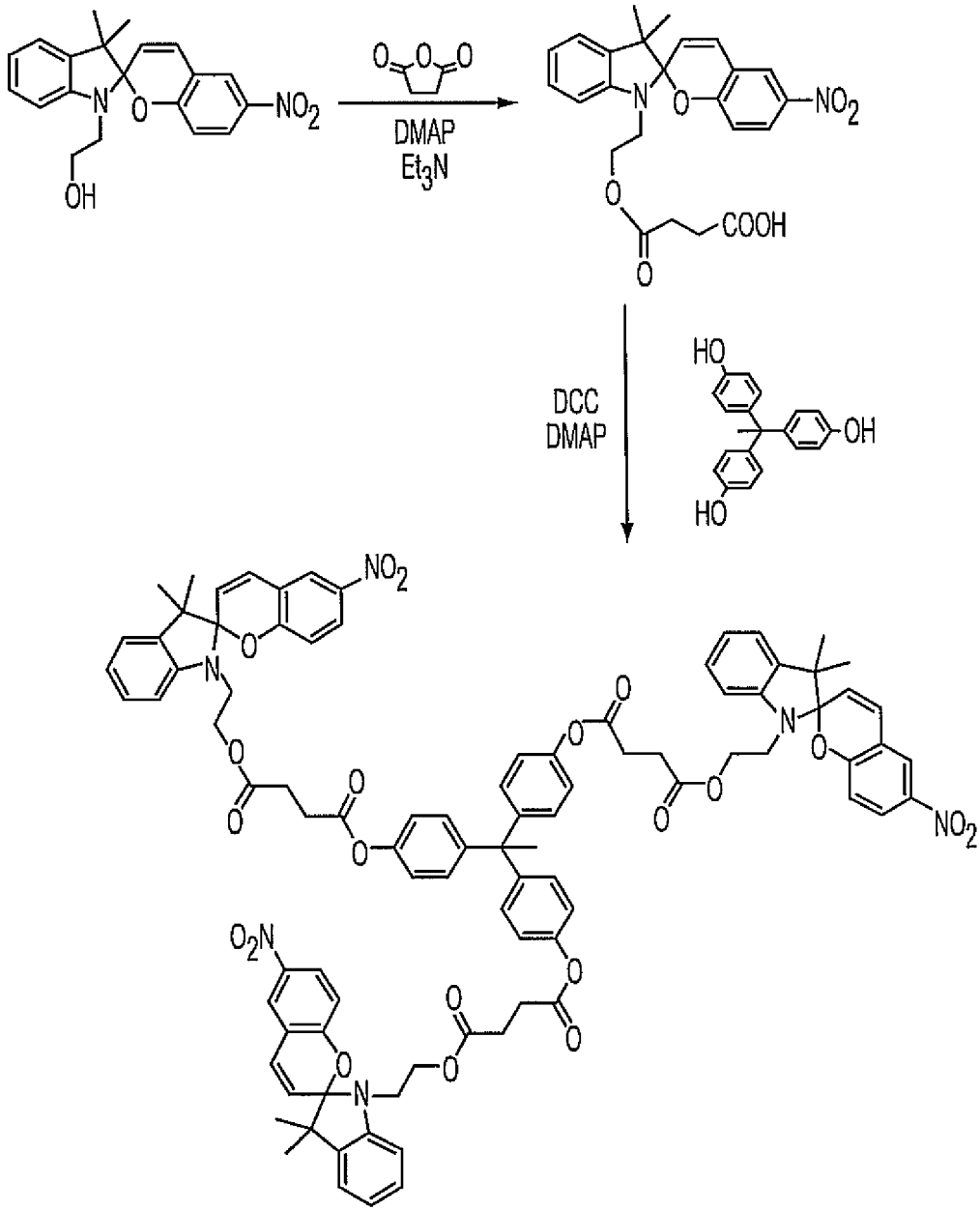
FIG. 13 depicts an exemplary preparation process of SP trimer in accordance with various embodiments of the present teachings.

An exemplary preparation process of SP phthalic-dimer is shown in FIG. 12, while an exemplary preparation process of SP trimer is shown in FIG. 13 in accordance with various embodiments of the present teachings.

In a particular example, about 1 g of 1-(2-Hydroxyethyl)-3,3-dimethylindolino-6'-nitrobenzopyrylospiran (TCI America), about 0.21 g of phthalic anhydride, and about 0.17 g of DMAP were dissolved in about 30 ml of dichloromethane. After addition of about 0.64 g of DCC, the solution was stirred at room temperature for about 18 hours. Resulting solid was filtered off and the filtrate was washed with 5% aqueous hydrochloric acid, aqueous sodium bicarbonate, and water, then dried over magnesium sulfate. After the solvent was distilled off, the concentrated solution was added dropwise into stirred hexane to yield SP Phthalic-dimer.

About 2 g of 1-(2-Hydroxyethyl)-3,3-dimethylindolino-6'-nitrobenzopyrylospiran (TCI America), about 0.44 ml of triethylamine, and about 0.69 g of 4-(dimethylamino)pyridine were dissolved in about 30 ml of dichloromethane. After addition of about 0.59 g of succinic anhydride, the solution was stirred under Ar at room temperature for about 19 hours. The mixture was washed with 5% aqueous hydrochloric acid, aqueous sodium bicarbonate, and water, then dried over magnesium sulfate. After the solvent was distilled off, the concentrated solution was added dropwise to hexane under stirring. The resulting solid was collected by filtration to yield 4-(2-(3',3'-dimethyl-6-nitrospiro[chromene-2,2'-indoline]-1'-yl)ethoxy)-4-oxobutanoic acid.

About 0.7 g of the latter product, about 0.16 g of 1,1,1-tris(4-hydroxyphenyl)ethane, and about 0.19 g of DMAP were dissolved in about 10 ml of dichloromethane. After addition of about 0.32 g of DCC, the solution was stirred at room temperature for about 17 hours. Resulting solid was filtered off and the filtrate was washed with 5% aqueous hydrochloric acid, aqueous sodium bicarbonate, and water, then dried over magnesium sulfate. After the solvent was distilled off, the concentrated solution was added dropwise into stirred hexane to yield SP Trimer.

Example II-3

Preparation and Writing of Erasable Media Containing SP, SP Phthalic-Dimer and SP Trimer As a control experiment that contains SP, about 45 mg (0.14 mmol) SP of Example II-1 were dispersed in 3 ml of PMMA (35K) solution (10 w % in toluene) to form a control coating composition. The control coating composition were then be coated on Xerox 4200 paper substrate, then dried in air overnight.

Similarly, about 58 mg (0.07 mmol) SP phthalic-dimer of Example II-2 was dispersed in 3 ml of PMMA (35K) solution (10 w % in toluene) to form a coating composition. The coating composition was coated on Xerox 4200 paper substrate, then dried in air overnight. About 76 mg (0.047 mmol) SP trimer of Example II-2 was dispersed in 3 ml of PMMA (35K) solution (10 w % in toluene) to form a coating composition. The coating composition was coated on Xerox 4200 paper substrate, then dried in air overnight The prepared samples were partially irradiated with a UV LED at a wavelength of about 365 nm to write an image therein to make contrast between written image and background, then covered by a yellow protection filter film (Lee yellow film). The samples were placed under a 400 lux fluorescent lamp at room temperature, mimicking standard office lighting condition.

Example II-4

ΔOD Measurements of Erasable Media Containing SP, SP Phthalic-Dimer and SP Trimer As similarly described in Example I-5, optical density (OD) was measured after a certain period of time from writing so as to evaluate the lifetime of the written image. In this case, ΔOD was measured for more than about 20 hours from the initial writing on all erasable media of Example II-3 respectively containing SP control, SP trimer and SP phthalic-dimer.

Figure 14:
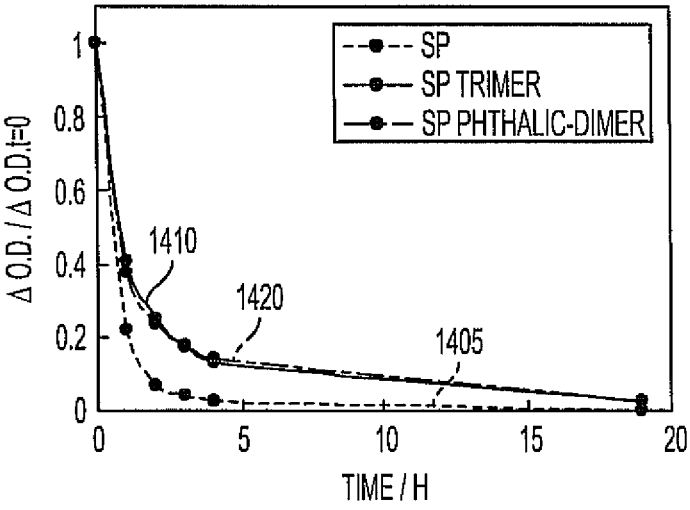
FIG. 14 depicts a comparison between exemplary erasable media containing spiropyran and oligomers in accordance with various embodiments of the present teachings.

As shown in FIG. 14, the erasable media of Example II-3 that contains SP trimer (see 1410) and SP phthalic-dimer (see 1420) clearly showed an improved image lifetime than the erasable medium that contains SP control (see 1405).

In addition, optical image results (not illustrated) showed that the image written in the erasable medium containing SP control disappeared in 2 hours under 400 lux light condition, but the images written in the erasable media containing the oligomers of SP phthalic-dimer and SP trimer still remained readable.

Figure 15:
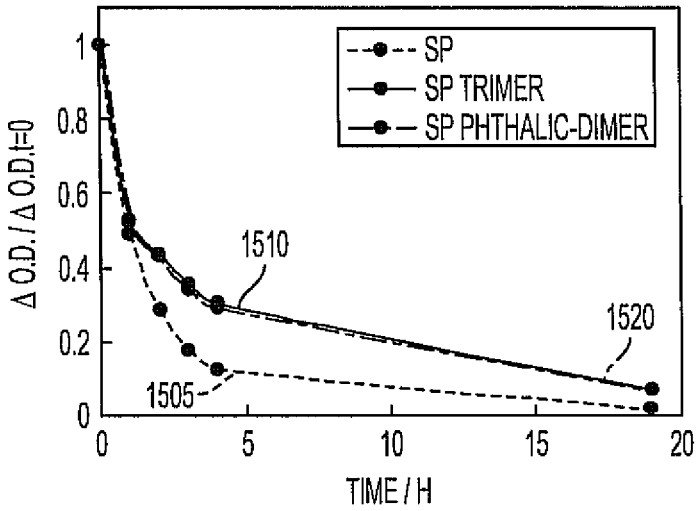
FIG. 15 depicts a comparison between exemplary erasable media in dark that contains spiropyran and oligomers in accordance with various embodiments of the present teachings.

Furthermore, image test in the dark, i.e., in the absence of room light, was also measured as shown in FIG. 15. The control erasable medium containing SP (see 1505) showed a decoloration in the absence of visible light, due to thermal reversion reaction at room temperature. In contrast, such thermal decoloration of images written in the erasable media containing the oligomers of SP trimer (see 1510) and SP phthalic-dimer (see 1520) were observed to be less than that of images formed in the control erasable medium containing SP.

Example II-5

Erasing of Erasable Media Containing SP, SP Phthalic-Dimer and SP Trimer

Written samples in Example II-4 containing SP control, SP Trimer and SP Phthalic-dimer were placed on a hot plate at about 100° C. After about 10 seconds, complete erase of the written image on each sample was observed.

While the present teachings have been illustrated with respect to one or more implementations, alterations and/or modifications can be made to the illustrated examples without departing from the spirit and scope of the appended claims. In addition, while a particular feature of the present teachings may have been disclosed with respect to only one of several implementations, such feature may be combined with one or more other features of the other implementations as may be desired and advantageous for any given or particular function, Furthermore, to the extent that the terms "including", "includes", "having", "has", "with", or variants thereof are used in either the detailed description and the claims, such terms are intended to be inclusive in a manner similar to the term "comprising." As used herein, the term "one or more of" with respect to a listing of items such as, for example, A and B, means A alone, B alone, or A and B. The term "at least one of" is used to mean one or more of the listed items can be selected.

Notwithstanding that the numerical ranges and parameters setting forth the broad scope of the present teachings are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all sub-ranges subsumed therein. For example, a range of "less than 10" can include any and all sub-ranges between (and including) the minimum value of zero and the maximum value of 10, that is, any and all sub-ranges having a minimum value of equal to or greater than zero and a maximum value of equal to or less than 10, e.g., 1 to 5. In certain cases, the numerical values as stated for the parameter can take on negative values. In this case, the example value of range stated as "less than 10" can assume values as defined earlier plus negative values, e.g. −1, −1.2, −1.89, −2, −2.5, −3, −10, −20, −30, etc.

Other embodiments of the present teachings will be apparent to those skilled in the art from consideration of the specification and practice of the present teachings disclosed herein. It is intended that the specification and examples be considered as exemplary only, with a true scope and spirit of the present teachings being indicated by the following claims.

What is claimed is:

1. An erasable medium comprising a substrate; and an imageable photochromic layer disposed on the substrate, wherein the imageable photochromic layer comprises a plurality of photochromic oligomers dispersed in a polymer, wherein each photochromic oligomer comprises at least 2 photochromic groups that are covalently linked together;

wherein each photochromic group is a spiropyran group, a spirooxazine group, a thiospiropyran group, or a methoxy spiropyran group;

wherein at least one functional group is attached to each photochromic group and the photochromic groups of the photochromic oligomer are covalently linked by reacting the functional group with a linker, wherein the linker is selected from the group consisting of

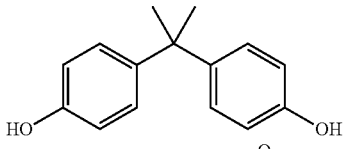

and

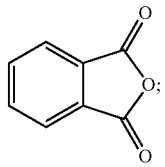

wherein the functional group comprises a carboxylic acid group, an amino group, a hydroxyl group, a halogenated hydrocarbon, an unsaturated hydrocarbon, an aldehyde, an acid chloride, an acid bromide, a thiol, a thioester, an azide, a boronic acid, or a boronic ester.

2. The medium of claim 1, wherein, after at least about 4 hours from an exposure to a radiant energy for converting from a colorless state to a colored state, the imageable photochromic layer fully reverts to the colorless state in an ambient condition.

3. The medium of claim 1, wherein the imageable photochromic layer further comprises an image that is readable for at least about 4 hours.

4. The medium of claim 3, further comprising a yellow protection film disposed over the imageable photochromic layer to prevent a reduction in color contrast between the image and a surrounding background area.

5. The medium of claim 1, wherein the photochromic oligomers are dispersed in the polymer in the amount ranging from about 0.05% to about 99.5% by weight of the total weight of the imageable photochromic layer.

6. The medium of claim 1, wherein the polymer is selected from the group consisting of polyalkylacrylates, polymethylmethacrylate (PMMA), polycarbonate, polystyrene, polysulfone, polyethersulfone, polyarylsulfone, polyarylether, polyolefin, polyacrylate, polyvinyl derivative, cellulose derivatives, polyurethane, polyamide, polyimide, polyester, silicone resin, epoxy resin, polyvinyl alcohol, polyacrylic acid, a copolymer comprising polystyrene-acrylonitrile, polyethylene-acrylate, vinylidenechloride-vinylchloride, vinylacetate-vinylidene chloride, and styrene-alkyd resin, and a mixture thereof.

7. The medium of claim 6, wherein the substrate is paper.

8. The medium of claim 1, wherein the substrate is selected from the group consisting of glass, ceramic, wood, plastic, fabric, textile, metal, plain paper, coated paper, no tear paper and mixtures thereof.

9. The medium of claim 1, further comprising a second imageable photochromic layer disposed over the substrate on a side opposite to the imageable photochromic layer, the second imageable photochromic layer comprising a plurality of photochromic oligomers dispersed in a polymer.

10. The medium of claim 1, wherein the substrate is paper.

* * * * *